US009738472B2

(12) United States Patent
Rothaug et al.

(10) Patent No.: US 9,738,472 B2
(45) Date of Patent: Aug. 22, 2017

(54) SHEET-TRANSPORTING DRUM AND PRINTING MACHINE HAVING THE SHEET-TRANSPORTING DRUM

(71) Applicant: HEIDELBERGER DRUCKMASCHINEN AG, Heidelberg (DE)

(72) Inventors: Juergen Rothaug, Nussloch (DE); Arno Juenger, Walldorf (DE); Albert Maul, Heidelberg (DE); Sven Goll, Heidelberg (DE); Thomas Schmidt, Heidelberg (DE); Alexander Knabe, Heidelberg (DE); Daniel Conzelmann, Dielheim (DE); Wolfgang Dolz, Heidelberg (DE); Kai Oskar Mueller, Birkenau (DE); Raimund Schroeder, Hockenheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 15/134,598

(22) Filed: Apr. 21, 2016

(65) Prior Publication Data

US 2016/0325953 A1 Nov. 10, 2016

(30) Foreign Application Priority Data

May 6, 2015 (DE) ..... 10 2015 208 335

(51) Int. Cl.
*B65H 5/02* (2006.01)
*B65H 5/04* (2006.01)
(Continued)

(52) U.S. Cl.
CPC ..... *B65H 5/08* (2013.01); *B41F 21/10* (2013.01); *B65H 2405/50* (2013.01)

(58) Field of Classification Search
CPC ... B65H 5/08; B65H 5/10; B65H 5/12; B65H 5/14; B65H 2404/40; B65H 2406/131;
(Continued)

(56) References Cited

U.S. PATENT DOCUMENTS 4,202,268 A * 5/1980 Becker ..... B41F 21/108 101/232
5,172,634 A 12/1992 Iwamoto
(Continued)

FOREIGN PATENT DOCUMENTS

DE 4221046 A1 1/1994
DE 10102226 A1 7/2002
EP 1415804 A1 5/2004

*Primary Examiner* — Prasad Gokhale
(74) *Attorney, Agent, or Firm* — Laurence A. Greenberg; Werner H. Stemer; Ralph E. Locher

(57) ABSTRACT

A sheet-transporting drum includes sheet-supporting areas each being formed of a first comb segment and a second comb segment having segment teeth. At least one of the comb segments is rotatable for adaptation to a sheet format. A mechanical leading-edge gripper is provided on the first comb segment and a pneumatic trailing-edge gripper is provided on the second comb segment. A mechanical trailing-edge gripper is additionally disposed on the second comb segment and is deactivatable in particular by format adjustments. This advantageously allows either the trailing edge of a sheet to be securely held down mechanically or a full-bleed print to be applied to the sheet when the trailing edge of the sheet is held down pneumatically. A sheet-fed printing machine is also provided.

9 Claims, 3 Drawing Sheets

(51) Int. Cl.
*B65H 5/08* (2006.01)
*B41F 21/10* (2006.01)

(58) Field of Classification Search
CPC ..... B65H 2405/50; B65H 2405/51; B65H 2405/53; B65H 2405/531; B65H 2405/54; B65H 2405/56; B65H 2405/572; B65H 2405/58; B65H 2405/581; B65H 2405/5812; B65H 2405/582; B41F 21/10; B41F 21/102; B41F 21/104
See application file for complete search history.

(56) References Cited

U.S. PATENT DOCUMENTS

| | | | | |
|---|---|---|---|---|
| 6,659,456 | B2 * | 12/2003 | Hieb | B41F 21/106 101/409 |
| 7,150,456 | B2 * | 12/2006 | Gerstenberger | B41F 21/108 271/276 |
| 8,632,156 | B2 | 1/2014 | Korogi et al. | |
| 9,365,029 | B2 * | 6/2016 | Maul | B41F 23/0406 |
| 2001/0015523 | A1 * | 8/2001 | Helmstadter | B65H 5/12 271/276 |
| 2004/0040457 | A1 * | 3/2004 | McManus | B41C 1/1083 101/409 |
| 2006/0042486 | A1 * | 3/2006 | Forch | B41F 21/102 101/230 |
| 2009/0284561 | A1 * | 11/2009 | Fukui | B41J 29/38 347/16 |
| 2011/0234730 | A1 | 9/2011 | Fukui et al. | |

* cited by examiner

SHEET-TRANSPORTING DRUM AND PRINTING MACHINE HAVING THE SHEET-TRANSPORTING DRUM

CROSS-REFERENCE TO RELATED APPLICATION

This application claims the priority, under 35 U.S.C. §119, of German Patent Application DE 10 2015 208 335.7, filed May 6, 2015; the prior application is herewith incorporated by reference in its entirety.

BACKGROUND OF THE INVENTION

Field of the Invention

The invention relates to a sheet-transporting drum in a sheet-processing machine including at least one sheet-supporting area formed of a first comb segment and a second comb segment each having respective segment teeth. At least one of the comb segments is rotatable for adaptation to a sheet format. A mechanical leading-edge gripper is disposed on the first comb segment and a pneumatic trailing-edge gripper is disposed on the second comb segment. The invention further relates to a sheet-fed printing machine including the sheet-transporting drum.

The use of digital printing machines to print short runs or customized printed images on sheets of paper, paperboard and cardboard is known in the art. When inkjet heads are used to print on the sheets, a transport system moves a respective sheet underneath the inkjet heads at a minimum distance. Known transport systems are revolving transport belts, for instance embodied as suction belts, and rotating cylinders, also known as jetting cylinders, or revolving tables.

Machine concepts that use cylinders as described, for instance, in U.S. Patent Application Publication US 2009/0284561 A1, include a number of inkjet print heads disposed above a jetting cylinder to print on sheets that are moved past at a short distance from the print heads. A jetting cylinder may simultaneously hold a plurality of sheets by suction and transport them.

In order to guarantee a high printing quality and to avoid damage to the print heads, an important aspect is to ensure that a respective sheet rests securely on the jetting cylinder. If a sheet does not rest securely thereon and if dog ears protrude, for instance, the print heads may be damaged. In order to prevent that from occurring, it is known to equip the printing machine with a detection device and to quickly stop the machine if there are any corners or edges that stick out. However, that means a considerably reduction of the throughput of the machine.

Sheet-transporting drums including gripper systems for holding the sheets to be transported are known as devices for guiding sheets and are disclosed, for instance, in German Patent Application DE 42 21 046 A1, corresponding to U.S. Pat. No. 5,172,634; German Patent Application DE 101 02 226 A1, corresponding to U.S. Pat. No. 6,659,456; and European Patent Application EP 1 415 804 A1, corresponding to U.S. Pat. No. 7,150,456.

SUMMARY OF THE INVENTION

It is accordingly an object of the invention to provide a sheet-transporting drum and a printing machine having the sheet-transporting drum, which overcome the hereinaforementioned disadvantages of the heretofore-known drums and machines of this general type and in which sheets are securely held at their edge regions on the sheet-transporting drum, at least reducing the disadvantages of the prior art and providing a greater efficiency of the machine.

With the foregoing and other objects in view there is provided, in accordance with the invention, a sheet-transporting drum of a machine for processing sheets, comprising at least one sheet-supporting area, in particular including suction openings to which suction air is applicable, wherein a respective sheet-supporting area is formed of a first comb segment and a second comb segment having segment teeth, wherein the teeth of the two segments mesh with one another and wherein at least one of the two comb segments is supported for rotation to adapt the sheet-supporting area to the sheet format, namely the sheet length. The first comb segment has a mechanical leading-edge gripper and the second comb segment has a pneumatic trailing-edge gripper for holding a respective sheet. In accordance with the invention, a mechanical trailing-edge gripper is additionally provided on the second comb segment. This advantageously either allows the trailing edge of a sheet to be mechanically held down in a very reliable way or a full-bleed print to be produced on the sheet when the trailing edge of the sheet is pneumatically held down. Due to the advantageous configuration of the mechanical trailing-edge gripper on the second comb segment, the mechanical adjustment system that is present anyway may be used to adjust the format and to retract the mechanical trailing-edge gripper.

In the sheet-transporting drum of the invention, the mechanical trailing-edge gripper is deactivatable. This may, in particular, be done by a format adjustment.

In accordance with an advantageous further development of the sheet-transporting drum of the invention, the pneumatic trailing-edge gripper is disposed between the mechanical trailing-edge gripper and the tips, i.e. ends, of the segment teeth of the second comb segment.

For this purpose, an advantageous embodiment of the sheet-transporting drum may include an adjustment device for pivoting the second comb segment relative to the first comb segment in such a way that either the pneumatic trailing-edge gripper or the mechanical trailing-edge gripper can be aligned with the trailing edge of the respective sheet to be transported. In other words, the trailing edge of a respective sheet is held down either by the pneumatic trailing-edge gripper or by the mechanical trailing-edge gripper. It is deemed to be advantageous if the adjustment device has an adjustment drive connected to the second comb segment, in particular an electric motor and an associated control unit. The adjustment device is thus used for format adjustments and for deactivating the mechanical trailing-edge gripper.

In accordance with a further development of the sheet-transporting drum, the mechanical trailing-edge gripper and/or the mechanical leading-edge gripper has a gripper bar with grippers fixed thereto, the gripper bar extending over the width of the sheet-transporting drum. A respective gripper may include gripper fingers and gripper pads for clamping a respective sheet therebetween, and the gripper fingers may be of particularly flat construction, i.e. they may have a low height. This ensures that processing tools such as inkjet heads that are disposed above the sheet-transporting drum may be disposed at a short distance from the sheet-transporting drum. In addition, the grippers may be disposed in such a way as to be retractable to reduce the risk of collisions even further.

In accordance with an advantageous further development of the sheet-transporting drum of the invention, the pneumatic trailing-edge gripper is embodied as a suction groove, which may in particular extend over the width of the sheet-transporting drum. Alternatively, suction bores may be used.

In a particularly advantageous and thus preferred embodiment, the sheet-transporting drum is a jetting cylinder for holding and transporting sheets that are to be printed in an inkjet process.

With the objects of the invention in view, there is concomitantly provided a sheet-fed printing machine, comprising a sheet-transporting drum as described above. The machine may be embodied as a digital printing machine, in particular including inkjet heads disposed at a distance from and substantially above the sheet-transporting drum.

Other features which are considered as characteristic for the invention are set forth in the appended claims.

Although the invention is illustrated and described herein as embodied in a sheet-transporting drum and a printing machine having the sheet-transporting drum, it is nevertheless not intended to be limited to the details shown, since various modifications and structural changes may be made therein without departing from the spirit of the invention and within the scope and range of equivalents of the claims. The invention described above and the advantageous further developments thereof described herein in combination with one another also form advantageous further developments of the invention, inasmuch as this makes sense from a technical point of view.

The construction and method of operation of the invention, however, together with additional objects and advantages thereof will be best understood from the following description of specific embodiments when read in connection with the accompanying drawings.

DETAILED DESCRIPTION OF THE INVENTION

Figure 4:
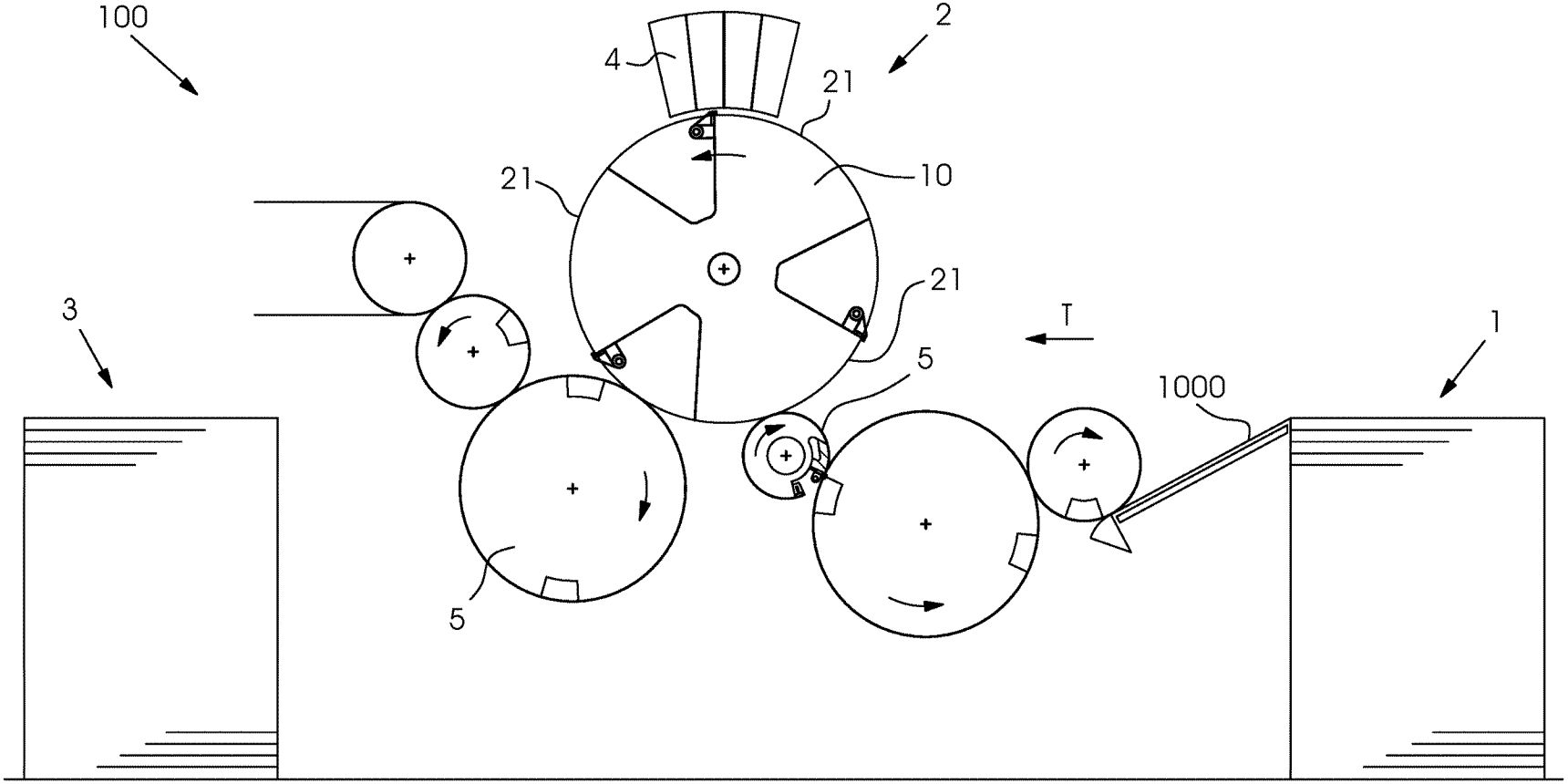
FIG. 4 is a longitudinal-sectional view of a digital printing machine.

Referring now in detail to the figures of the drawings, in which mutually corresponding elements and components have the same reference numerals and in which the figures are not drawn to scale, and first, particularly, to FIG. 4 thereof, there is seen a sheet-fed printing machine 100 embodied as a digital printing machine. A respective sheet 1000 coming from a feeder 1 is transported through a printing unit 2 to a delivery 3 in a direction of transport T. The transporting of a respective sheet 1000 is mainly carried out by cylinders, namely transfer cylinders 5 and a sheet-transporting drum 10, embodied as a jetting cylinder. In the exemplary embodiment, the jetting cylinder 10 has three sheet-supporting areas 21. Inkjet heads 4 are disposed above the jetting cylinder 10. The inkjet heads 4 print on a sheet 1000 that is transported past the inkjet heads 4 by the jetting cylinder 10 at a short distance.

Figure 1B:
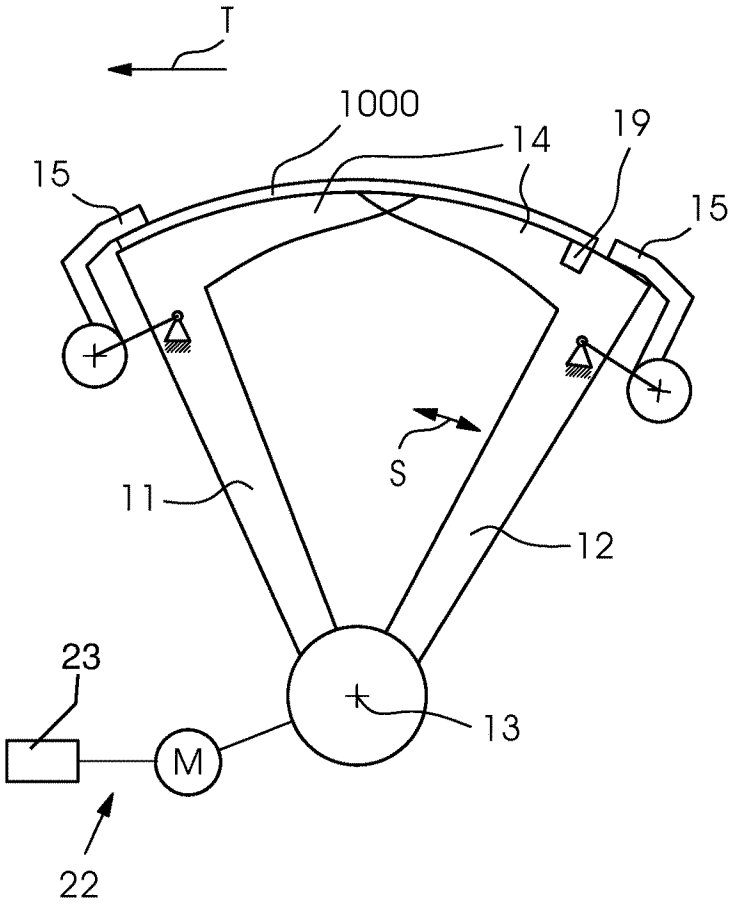
FIGS. 1A and 1B are diagrammatic, side-elevational views of comb segments of a sheet-transporting drum in two different positions.
Figure 1A:
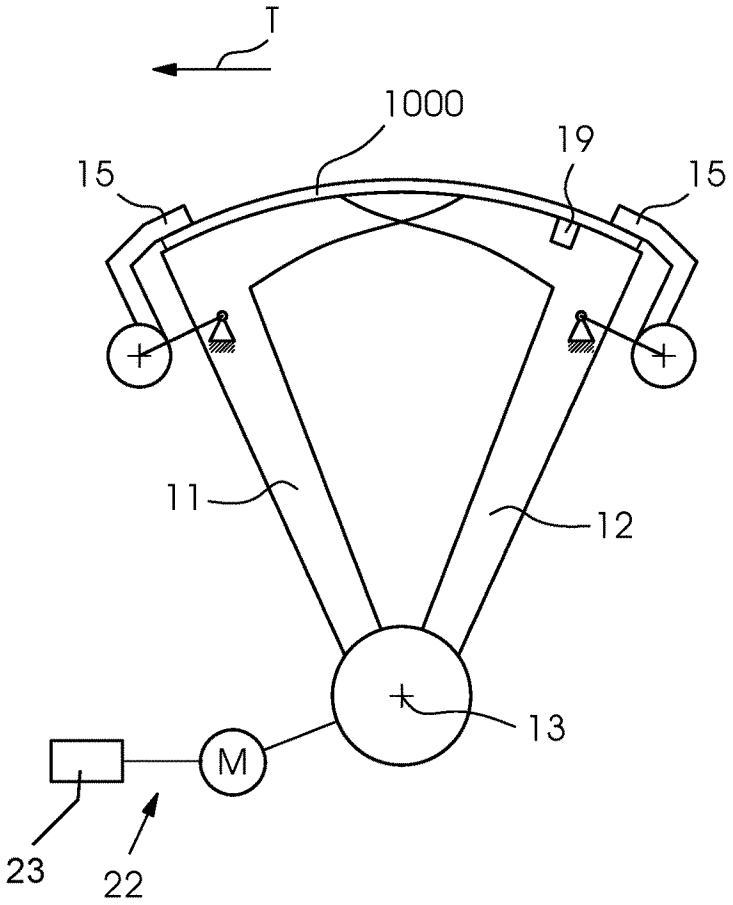

FIGS. 1A and 1B illustrate a section of a sheet-transporting drum 10, namely a first comb segment 11 and a second comb segment 12, which may be adjusted to adapt a sheet-supporting area to a sheet format, i.e. the length, of a respective sheet 1000. The first comb segment 11 and the second comb segment 12 have respective teeth 14 engaging in a rake-like way, causing the first segment 11 and the second segment 12 to mesh with one another. The second comb segment 12 may be pivoted about a pivot axis 13 and may carry out a pivoting movement S.

A mechanical gripper 15, embodied as a mechanical leading-edge gripper for holding down the leading edge of a sheet 1000, is disposed on the first comb segment 11. The second comb segment 12 is provided with a pneumatic gripper 19 and with a mechanical gripper 15. As shown in FIG. 1A, the second comb segment 12 is pivoted relative to the first comb segment 11 in such a way that the mechanical gripper 15 thereof holds down the trailing edge of a sheet 1000. The pneumatic gripper 19 of the second comb segment 12 does not act directly on the trailing edge of the sheet 1000 but only on the trailing part of the sheet 1000. The mechanical trailing-edge gripper and/or the mechanical leading-edge gripper has a gripper bar 32 with grippers fixed thereto, the gripper bar 32 extends over the width of the sheet-transporting drum 10.

If the trailing edge of the sheet 1000 is not to be held down by the mechanical trailing-edge gripper 15 but instead by the pneumatic gripper 19, the second comb segment 12 is pivoted farther in the clockwise direction S relative to the first comb segment 11, deactivating the mechanical trailing-edge gripper 15 and positioning the pneumatic gripper 19 in the region of the trailing edge of the sheet. The pivoting movement S is caused by an adjustment device 22, which has an electric motor M and a control unit 23 and is also used to adjust the sheet-supporting areas 21 formed by the teeth 14 of the comb segments 11, 12, in order to accommodate the sheet format.

Figure 2:
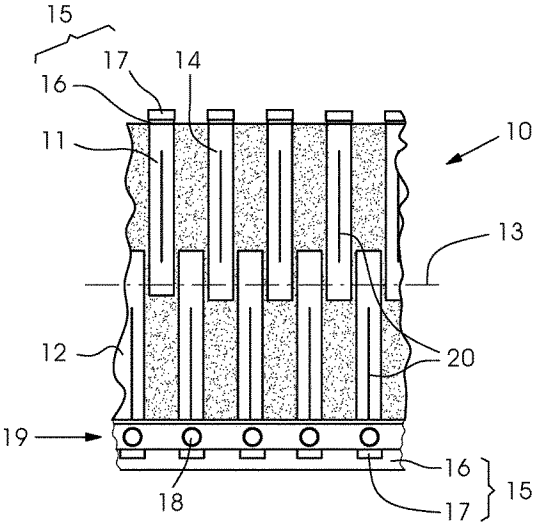
FIG. 2 is a fragmentary, top-plan view of the sheet-transporting drum.

FIG. 2 is a top view of the sheet-transporting drum 10 showing that the sheet-transporting drum 10 includes at least a first comb segment 11 and a second comb segment 12, which is supported to rotate/pivot relative to the first comb segment 11 about a pivot axis 13, which corresponds to the middle or central axis of the sheet-transporting drum 10, in order to adjust the sheet-transporting drum 10 to accommodate different format lengths of sheets 1000 to be transported. Each one of the comb segments 11, 12 has teeth 14 that engage in interspaces between the teeth 14 of the respective other comb segment 12, 11.

When the second comb segment 12 is adjusted towards the first comb segment 11 to accommodate a smaller sheet format, the teeth 14 move deeper into the interspaces, causing the interspaces to narrow. In order to accommodate a larger sheet format, the second comb segment 12 is moved away from the first comb segment 11, causing the interspaces to widen.

The gripper system 15 of the sheet-transporting drum 10 has gripper pads 16 and gripper fingers 17 associated therewith on the front edge of the first comb segment 11 to clamp/cover the sheet of printing material. The second comb segment 12 has nozzle-shaped suction elements 18 disposed thereon for attracting the trailing edge of the sheet of printing material 1000 by suction. The suction elements 18 are disposed in a row and are connected to a (non-illustrated) suction air source. Alternatively, a suction groove may be provided instead of the suction nozzles 18. The gripper system 15 of the sheet-transporting drum 10 has gripper pads 16 and gripper fingers 17 associated therewith on the rear edge of the second comb segment 12 to clamp the sheet of printing material. Thus, a mechanical leading-edge gripper 15, a mechanical trailing-edge gripper 15 and a pneumatic trailing-edge gripper 19 are provided. In order to adjust the required distance between the gripper system 15 and the suction elements 18 as a function of the format length, the suction elements 18, together with the second comb segment 12, are pivoted relative to the gripper system 15 of the first comb segment 11 about the pivot axis 13 until they are in a position in which the suction elements 18 are close to the trailing edge of the sheet of printing material 1000 held in the gripper system and underneath the sheet. As described above, a format adjustment may likewise occur in such a way that the trailing edges of the sheets 1000 are held by the mechanical trailing-edge gripper 15.

The first comb segment 11 and the second comb segment 12 may have suction grooves 20 that ensure that a sheet 1000 rests securely thereon.

Figure 3:
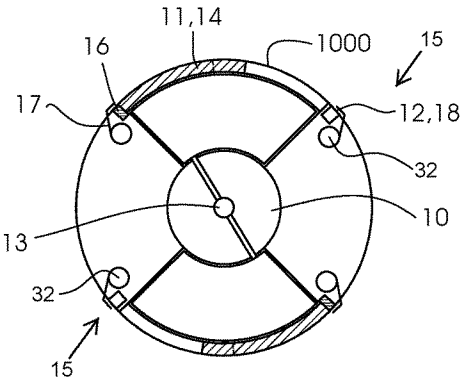
FIG. 3 is a lateral-sectional view of the sheet-transporting drum.

FIG. 3 is a lateral sectional view of the sheet-transporting drum 10 of FIG. 2.

The invention claimed is:

1. A sheet-transporting drum in a sheet-processing machine, the sheet-transporting drum comprising:

at least one sheet-supporting area formed of a first comb segment and a second comb segment each having respective segment teeth;

at least one of said first and second comb segments being rotatable for adaptation to a sheet format;

a mechanical leading-edge gripper being disposed on said first comb segment;

a pneumatic trailing-edge gripper being disposed on said second comb segment; and a deactivatable mechanical trailing-edge gripper being disposed on said second comb segment, said pneumatic trailing-edge gripper being disposed between said mechanical trailing-edge gripper on said second comb segment and tips of said segment teeth on said second comb segment.

2. The sheet-transporting drum according to claim 1, which further comprises an adjustment device for pivoting said second comb segment relative to said first comb segment to align either said pneumatic trailing-edge gripper or said mechanical trailing-edge gripper on said second comb segment with a trailing edge of a respective sheet to be transported.

3. The sheet-transporting drum according to claim 2, wherein said adjustment device has an adjustment drive connected to said second comb segment and a control unit.

4. The sheet-transporting drum according to claim 1, wherein at least one of said mechanical trailing-edge gripper or said mechanical leading-edge gripper has a gripper bar with grippers fixed thereto, said gripper bar extending over a width of the sheet-transporting drum.

5. The sheet-transporting drum according to claim 4, wherein each said mechanical gripper has respective flat gripper fingers and gripper pads.

6. The sheet-transporting drum according to claim 1, wherein said pneumatic trailing-edge gripper is a suction groove.

7. The sheet-transporting drum according to claim 1, wherein the sheet-transporting drum is a jetting cylinder.

8. A sheet-fed printing machine, comprising:

a sheet-transporting drum according to claim 1.

9. A digital sheet-fed printing machine, comprising:

a sheet-transporting drum according to claim 1; and inkjet heads disposed above said sheet-transporting drum.

* * * * *